US006895759B2

(12) United States Patent
Knoepfel

(10) Patent No.: US 6,895,759 B2
(45) Date of Patent: May 24, 2005

(54) PREMIX BURNER AND METHOD OF OPERATION

(75) Inventor: Hans Peter Knoepfel, Dottikon (CH)

(73) Assignee: ALSTOM Technology LTD, Baden (CH)

( * ) Notice: Subject to any disclaimer, the term of this patent is extended or adjusted under 35 U.S.C. 154(b) by 0 days.

(21) Appl. No.: 10/629,605

(22) Filed: Jul. 30, 2003

(65) Prior Publication Data

US 2004/0055307 A1 Mar. 25, 2004

Related U.S. Application Data

(63) Continuation of application No. PCT/IB02/00384, filed on Feb. 1, 2002.

(30) Foreign Application Priority Data

Feb. 2, 2001 (DE) ..... 101 04 695

(51) Int. Cl.[7] ..... F23R 3/36
(52) U.S. Cl. ..... 60/776; 60/737
(58) Field of Search ..... 60/776, 737; 431/183, 431/284

(56) References Cited

U.S. PATENT DOCUMENTS

| | | | | |
|---|---|---|---|---|
| 5,295,352 A | | 3/1994 | Beebe et al. | 60/39.06 |
| 5,452,574 A | | 9/1995 | Cowell et al. | 60/39.23 |
| 5,896,741 A | | 4/1999 | Etheridge | 60/39.23 |
| 5,899,076 A | * | 5/1999 | Snyder et al. | 60/740 |
| 6,038,864 A | * | 3/2000 | Prade et al. | 60/748 |
| 6,141,967 A | | 11/2000 | Angel et al. | 60/737 |
| 6,161,387 A | | 12/2000 | Green | 60/748 |
| 6,539,721 B2 | * | 4/2003 | Oikawa et al. | 60/737 |
| 6,632,084 B2 | * | 10/2003 | Berenbrink | 431/284 |

FOREIGN PATENT DOCUMENTS

| | | |
|---|---|---|
| DE | 2 317 260 | 11/1973 |
| DE | 195 07 088 A1 | 9/1996 |
| DE | 195 42 164 A1 | 5/1997 |
| DE | 195 45 310 A1 | 6/1997 |
| EP | 0 387 532 A1 | 9/1990 |
| WO | 99/04196 | 1/1999 |
| WO | 02/061339 | 8/2002 |

OTHER PUBLICATIONS

Search Report in International Application PCT/IB02/00384 (Apr. 18, 2002).
Search Report in German Application 101 04 695.2 (Mar. 21, 2002).
Correa, Sanjay M., "A Review of NOx formation under gas–turbine combustion conditions", Combust. Sci. and Tech., vol. 87, pp. 329–362 (Gordon and Breach Science Publishers, UK, 1992).

* cited by examiner

*Primary Examiner*—Ehud Gartenberg
(74) *Attorney, Agent, or Firm*—Cermak & Kenealy, LLP; Adam J. Cermak

(57) ABSTRACT

A premix burner has a premix burner casing which is formed in the manner of a tube open at the upstream end, is connected in the downstream direction to a combustion chamber via a transition contour and through which air can flow, a burner lance including an inner tube that projects into the interior of the premix burner casing on the upstream side, encloses a flow passage which is annular in cross section together with the premix burner casing, and has an inner tube wall which surrounds an inner flow passage and in which there is at least one fuel-addition unit for feeding fuel into the inner flow passage and at least one further fuel-addition unit for feeding fuel into the annular flow passage is provided so that downstream of the inner tube the fuel/air mixture ignites within the flame front in the region of the combustion chamber.

23 Claims, 5 Drawing Sheets

PREMIX BURNER AND METHOD OF OPERATION

This application is a continuation of and claims priority under 35 U.S.C. §120 to International Application No. PCT/IB02/00384, filed Feb. 1, 2002, published as WO 02/061339 on Aug. 8, 2002 in German, and this application claims priority under 35 U.S.C. §119 to German application number 101 04 695.2, filed Feb. 2, 2001; the entireties of both of the aforementioned applications are incorporated by reference herein.

BACKGROUND OF THE INVENTION

1. Field of the Invention

The invention relates to a premix burner for producing a homogeneously distributed fuel-air mixture for firing a combustion chamber which is used to drive a gas turbine which follows the combustion chamber.

2. Discussion of Background

The technique known as premix combustion has established itself in the combustion of liquid or gaseous fuel in a combustion chamber of a gas turbine. In this process, fuel and combustion air are premixed as uniformly as possible and are then passed into the combustion chamber and ignited. To comply with ecological aspects, a low flame temperature is maintained by means of a high excess of air. In this way, it is possible to keep the formation of nitrogen oxide at a low level.

A typical premix burner is known, for example, from EP-387 532 A1. Premix burners of this type are what are known as double cone burners which substantially comprise two hollow, conical part-bodies which are interleaved in the direction of flow. In this arrangement, the respective center axes of the two part-bodies are offset with respect to one another. In their longitudinal direction, the adjacent walls of the two part-bodies form tangential slots for the combustion air which passes into the interior of the burner in this way. A fuel nozzle for liquid fuel is arranged there. The fuel is injected into the hollow cone at an acute angle. The conical liquid fuel profile which is generated is surrounded by the combustion air flowing in tangentially. The concentration of the fuel is continuously reduced in the axial direction as a result of its mixing with the combustion air.

The premix burner can also be operated with gaseous fuel. For this purpose, gas inflow openings, known as the premix holes, which are distributed in the longitudinal direction, are provided in the walls of the two part-bodies in the region of the tangential slots. In gas mode, therefore, the mixture formation with the combustion air commences as early as in the zone of the inlet slots. It will be understood that in this way mixed operation with both types of fuel is also possible. At the burner outlet, a fuel concentration which is as homogeneous as possible is established over the annular cross section which is acted on. A defined spherical cap-shaped backflow zone is formed at the burner outlet, the ignition taking place at the tip of this zone, known as the flame front.

It is known from various documents, for example Combust. Sci. and Tech. 1992, Vol. 87, pages 329 to 362, that with a perfectly premixed flame the size of the backflow zone, which is equivalent to what is known as the flame stabilization region, has no influence on the nitrogen oxide emissions. On the other hand, however, the carbon oxide emissions and the emissions relating to unsaturated hydrocarbons (UHC) and in particular the extinction limits of the respective premix burners are greatly influenced by the size of the backflow zone. This means that the larger the backflow zone is designed to be, the greater the carbon oxide emissions, the emissions relating to unsaturated hydrocarbons and the extinction limit become. The result of this is also that with a larger backflow zone it is possible to cover a wider load range of the premix burner without the flame being extinguished. In addition to the size of the backflow zone, which, as explained above, has a decisive influence on the method of operation of the individual premix burners, the fuel distribution, i.e. the mixing profile of the fuel/air mixture, also has a major role in the area of flame stabilization.

If the above-described premix burner is supplied with premix gas uniformly along the premix holes, i.e. as part of a single-stage premix mode, stability problems result within the backflow zone which forms and the associated flame front if the fuel mass flow drops, for example when the gas turbine is operated in the lower load range. At the same time, the lower fuel mass flow also causes the depth of penetration of the premix gas supply to decrease along the premix injection, so that the core zone of the flame front which is formed in the shape of a spherical cap becomes leaner within the burner. The instability which then occurs can extinguish the flame. To achieve improved flame stabilization under these operating conditions, the premix burner is switched over to what is known as "pilot mode" in which gaseous fuel is injected along the premix burner in the vicinity of the central fuel nozzle. However, a pilot mode of this nature leads to the formation of a diffusion flame, with the result that very high exhaust-gas values, in particular very high $NO_x$ emissions, are reached. If the premix burner is operated in what is known as mixed mode, which is distinguished by fuel being injected both through the premix stage and through the pilot stage, combustion chamber pulsations increasingly occur in addition to the abovementioned increased exhaust-gas values, increasing the risk of a flashback into the premix burner region.

SUMMARY OF THE INVENTION

Accordingly, one object of the invention is to improve a premix burner in such a way that the drawbacks which have been mentioned above in connection with the prior art no longer occur or only appear to a considerably reduced degree. In particular, the aim is to design a premix burner in such a manner that the operating range of the burner is distinguished by a high level of stability even under low load conditions, i.e. flashback of the backflow zone into the region of the premix burner is to be virtually completely eliminated. In particular, the aim is to configure the premix burner in such a manner that, despite high stability requirements and low exhaust-gas emissions, the premix burner is easy and inexpensive to adapt to different burner conditions. For example, it is intended in particular to ensure that the premix burner can be matched to individual burner conditions in a structurally simple manner and at the lowest possible cost.

The solution to the object on which the invention is based is given in claim 1. Claims 18 and 19 describe methods for operating the premix burner designed in accordance with the invention. Features which advantageously develop the basic idea of the invention form the subject matter of the subclaims and are to be found in particular in the description with reference to the exemplary embodiments shown in figures.

Unlike the above-described design of the double cone premix burner, which for design reasons has a fixed structure and is optimally matched to specific operating conditions, the premix burner which has been constructed in accordance with the invention is in principle distinguished by two components which can be combined in modular fashion.

Firstly, the premix burner has a premix burner casing, which is of tubular design, i.e. is basically in the shape of a tube or of a cup which is open on two sides, and at the downstream end is connected via a transition contour to the combustion chamber, which is followed by a gas turbine. The premix burner casing is designed to be open at the upstream end, so that air can flow through the casing.

The second component provided is a burner lance which is designed as an inner tube and projects through the upstream opening of the premix burner casing into the interior of the premix burner casing. The burner lance is designed in such a manner that, together with the premix burner casing, it encloses a flow passage which is annular in cross section. Moreover, the burner lance has an inner tube wall which surrounds an inner flow passage. The annular flow passage extends along the entire penetration depth of the burner lance within the premix burner casing and downstream of the burner lance is combined with the inner flow passage to form a unitary flow passage section which is delimited only by the transition contour between the premix burner casing and the combustion chamber. The transition contour is preferably designed in the manner of a venturi nozzle, so that a mass flow located within this flow section is subject to an increase in flow velocity.

Furthermore, at least one fuel-addition unit for feeding fuel into the inner flow passage is provided in the inner tube wall of the burner lance. In addition, the inner tube wall has at least one further fuel-addition unit for feeding fuel into the annular flow passage.

Depending on the particular application, the fuel-addition units can be supplied with liquid or gaseous fuel. In order to form a flame front which is stable inside the combustion chamber, it is preferable for a swirl generator, which applies a defined swirl number to the incoming air which flows into the annular flow passage, to be fitted to the outer side of the inner tube wall of the burner lance. The incoming air which enters the annular flow passage through the swirl generator is firstly swirled up in a direction of flow which is predetermined by the swirl generator and is secondly mixed with liquid and/or gaseous fuel along the annular flow passage. As it flows through the transition contour, the fuel/air mixture which forms within the annular flow passage combines to form a flow of uniform cross section with a homogeneous fuel/air distribution and then passes into the combustion chamber for ignition, where a stable flame front is formed as a result of the swirling flow breaking open.

Depending on the designed power of the gas turbine, it is possible to select the number of fuel-addition units provided within the inner tube wall to be variable as desired. Typically, there is one fuel-addition unit in the inner tube wall, through which gaseous fuel is fed into the annular flow passage. A second fuel-addition unit, which is used to introduce liquid fuel into the annular flow passage, is provided axially downstream of the first fuel-addition unit, as seen in the direction of flow. Of course, it is possible to provide a plurality of fuel-addition units which are arranged in succession in the axial direction and are used to feed either liquid or gaseous fuel into the annular passage.

To improve the stability of the flame front which forms within the combustion chamber and to widen the operating ranges of the combustion chamber which fires the gas turbine, inside the inner tube there is at least one fuel-addition unit which is used to feed preferably gaseous fuel into the inner flow passage, which is surrounded by the inner tube wall. Depending on the positioning of a gas supply into the inner flow passage along the burner lance in this respect, it is possible to use the gas feed as a pilot gas supply or as a piloted premix gas supply.

If a gas supply which is provided along the inner side within the inner tube wall is to be used as a pilot gas supply, a fuel-addition unit for this purpose is to be arranged in the vicinity of the downstream end of the burner lance, so that the gas is supplied in the axial vicinity of the flame front which forms inside the combustion chamber. A gas supply of this type forms a diffusion flame which is able to stabilize the flame front in particular in the case of lean operating modes, i.e. in part-load operation.

On the other hand, if the gas supply into the inner flow passage takes place at a distance from the downstream end of the burner lance in the longitudinal direction with respect to the extent of the burner lance, the pilot gas which is fed in is mixed with the feed air supplied through the inner flow passage, so that the pilot gas/air mixture is able to mix with the rest of the fuel/air mixture emanating from the annular flow passage even before ignition in the region of the flame front. A gaseous fuel feed of this type into the inner flow passage can be regarded as a premix pilot gas supply and contributes to increasing power in particular under high load conditions.

With the aid of the premix burner designed in accordance with the invention, it is on the one hand possible to put together premix burner configurations of different emphases in modular fashion merely by fitting individually adapted burner lances. This firstly contributes to inexpensive production of premix burner systems of this type, and secondly allows a single premix burner casing to be fitted with different burner lance modules should the customer's operating requirements change over the course of time.

The modular assembly of the premix burner designed in accordance with the invention is made possible by the fact that all the components which are of structural importance with regard to the operating characteristics of the premix burner are fitted in and to the tubular burner lance, such as for example one or more swirl generators and also suitably positioned fuel-addition units. This measure makes it possible to use a standardized premix burner casing which can be fitted with differently configured burner lances.

Furthermore, it is possible to provide a multiplicity of fuel-addition units which are arranged axially along the burner lance and are individually connected to fuel-feed lines. In this way, it is possible to ensure switching between the above-described pilot gas supply and the premix pilot gas supply without differently configured burner lances having to be implemented in the premix burner casing.

If the burner lance designed as an inner tube is designed to be substantially rectilinear along its axial extent, so that the inner flow passage has a virtually constant cross section of flow along its extent, a flame front which is stable within the combustion chamber is formed with the premix burner variant described above. A burner configuration of this kind accordingly leads to single-stage combustion.

However, if the inner tube wall is designed in the shape of a funnel in the region of the downstream end of the burner lance, in such a manner that the inner flow passage widens divergently in the direction of flow before the end of the burner lance, and if, moreover, a swirl generator for the air which enters the inner flow passage is provided at the upstream end of the burner lance, given a suitable feed of fuel into the inner flow passage it is possible for a second flame front, which occurs while still inside the inner flow passage and axially precedes the above-described flame front inside the combustion chamber, to be formed. Two-stage combustion of this nature has the advantage that the flue gases which are formed in the axially upstream combustion are fed to the combustion which follows it axially in the downstream direction, with the result that the nitrogen oxides formed by the combustion can be reduced to a decisive extent.

For the formation of a two-stage combustion, it is crucial for the downstream end region of the burner lance to be designed as a diffuser which causes the swirling flow introduced into the inner flow passage to break open while it is still within the region of the burner lance, forming a stable flame front. A corresponding gaseous-fuel-addition unit is to be positioned inside the tube wall between the swirl generator and the diffuser region of the burner lance.

The modular premix burner structure in accordance with the invention allows considerable variability with regard to the design of a premix burner, which leads from a single-stage system with pilot gas supply or premixed pilot to a two-stage burner system with two flame positions which are clearly separated from one another in the axial direction. Such a considerable variation can only be achieved by exchanging the inner burner lance.

The structure of the premix burner in accordance with the invention also results in a wide range of different options in terms of the form in which fuel, whether it be gaseous or liquid fuel, can be admixed with the combustion feed air. As explained above, an axially stepped implementation of the fuel injection can be realized without problems in order, for example, to optimally match the time delay between fuel injection and flame position to one another.

The premix burner design in accordance with the invention has the following advantages over existing burner designs:

1. more stable flame position,
2. lower emissions (CO, UHC, $NO_x$),
3. low pulsation on account of clearly defined flame position,
4. complete burn-up,
5. wide operating range,
6. modular structure,
7. improved mixing for the particular operating point, and
8. lower zeta value gradients.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
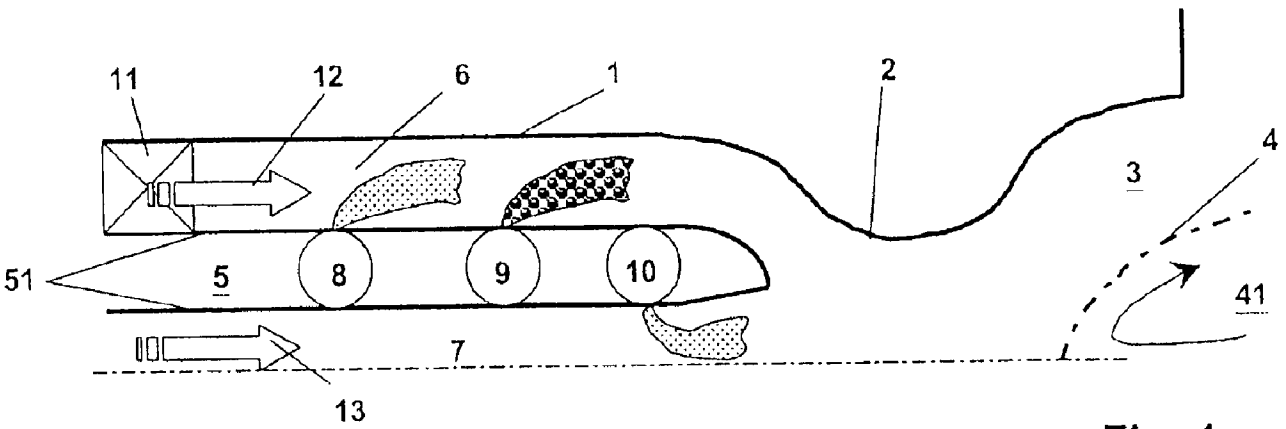
FIGS. 1 to 7 show various exemplary embodiments of a premix burner designed in accordance with the invention with single-stage combustion.

Referring now to the drawings, wherein like reference numerals designate identical or corresponding parts throughout the several views, all the figures illustrate longitudinal-section images through the premix burner structure, whose walls included in the drawing form rotationally symmetrical bodies, which means that in all the figures only the top half of the longitudinal section is illustrated and described.

FIG. 1, like all FIGS. 1 to 9, illustrates a tubular premix burner casing 1 which is designed to be open at its left-hand end as seen in the drawing. Feed air 12, 13 always flows through the premix burner casing 1 from the left to the right in the plane of the drawing. The premix burner casing 1 is axially followed in the direction of flow by a transition contour 2 which narrows the cross section of flow of the premix burner casing in the manner of a venturi nozzle. The region of the transition contour 2 which widens again in the cross section of flow is seamlessly adjoined by the combustion chamber 3, in which, as explained in detail below, a stable flame front 4 is formed. The above-described structure is present in all the exemplary embodiments shown in FIGS. 1 to 9, and consequently this basic structure will not be described repeatedly in the text which follows.

A burner lance 5, which is designed as an inner tube and has an inner tube wall 51, by means of which it, together with the premix burner casing 1, encloses an annular flow passage 6, has been introduced into the interior of the premix burner casing 1. An inner flow passage 7 is enclosed inside the burner lance 5 by the innermost inner tube wall 51. In accordance with the exemplary embodiments shown in FIGS. 1 to 7, the burner lance 5 has a virtually rectilinear inner tube wall profile, with the result that the cross sections of flow of both the annular flow passage and the inner flow passage remain virtually constant along the extent of the burner lance 5.

Inside the inner tube wall 51 there are fuel-addition units 8, 9, 10. Gaseous fuel flows out of the fuel-addition unit 8 into the annular flow passage 6, whereas liquid fuel is fed into the annular flow passage 6 from the fuel-addition unit 9 which axially follows the fuel-addition unit 8. Gaseous fuel is fed into the inner flow passage 7 through the fuel-addition unit 10 which is arranged close to the downstream end of the burner lance 5. A swirl generator 11, which is responsible for deliberately swirling up the secondary air 12 flowing into the annular flow passage 6, is also located at the burner lance 5. The secondary air 12 which has been swirled up is mixed with the types of fuel which have been fed in along the annular flow passage 6 to form a virtually homogeneously distributed fuel/air mixture which, after it has been brought together in the region of the transition contour 2 and its velocity has been increased appropriately as a result of the venturi nozzle contour, is ignited in the region of the combustion chamber 3. The breaking up of the swirling flow causes a dynamic backflow zone 41, which is characterized by the three-dimensionally stable flame front 4, to be established. A targeted supply of pilot gas via the fuel-addition unit 10, which on account of its spatial proximity to the flame front 4 leads to a diffusion flame and is therefore able to stabilize the flame front 4, is used to stabilize the flame front 4 which is formed within the combustion chamber 3, in particular in low load ranges, i.e. lean operating modes. Like the air supply through the annular flow passage 6, the inner flow passage 7 is also open at the upstream end, but designed without a swirl generator, so that primary air 13 can be supplied through the inner flow passage 7.

On account of the compact structure and the burner lance 5 provided with all the individual components required for flow manipulation and fuel supply, the premix burner casing 1 connected to the combustion chamber 3 can be fitted with individually designed burner lances. This is to be described with reference to the figures which follow, which do not represent all the possible variants. To avoid repetition, installation components which have already been described and provided with reference symbols are not explained in detail again. Reference is also made to the appended list of designations.

Figure 2:
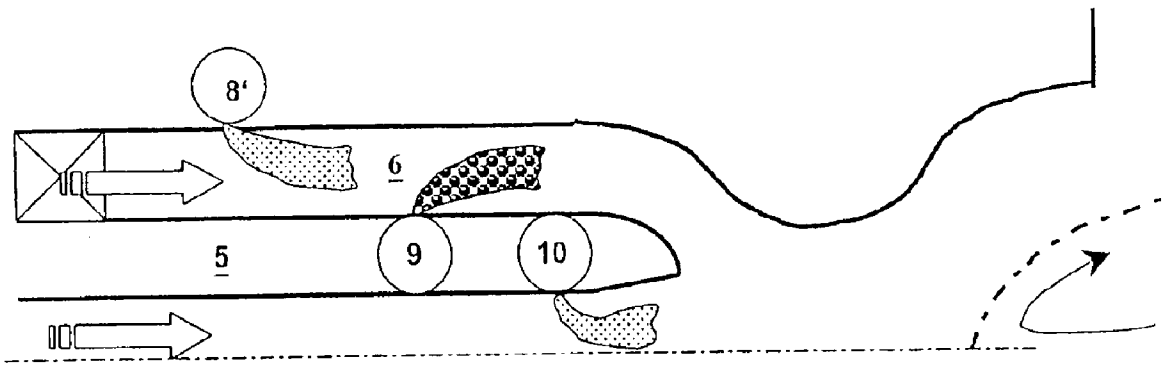

Unlike in FIG. 1, the premix burner variant illustrated in FIG. 2 has a fuel-addition unit 8' which is not integrated within the burner lance 5, but rather feeds gaseous fuel into the annular flow passage 6 from the outside through the premix burner casing 1. The remaining structure corresponds to that of the exemplary embodiment shown in FIG. 1. The exemplary embodiment illustrated in FIG. 2 is intended to demonstrate that a suitably configured burner lance 5 can be introduced into a premix burner casing 1, which for its part has certain peripheral components, such as for example a fuel-addition unit 8' for supplying gaseous fuel. This illustrates the virtually endless variability which can be achieved with the configuration of the burner lance 5.

Figure 3:
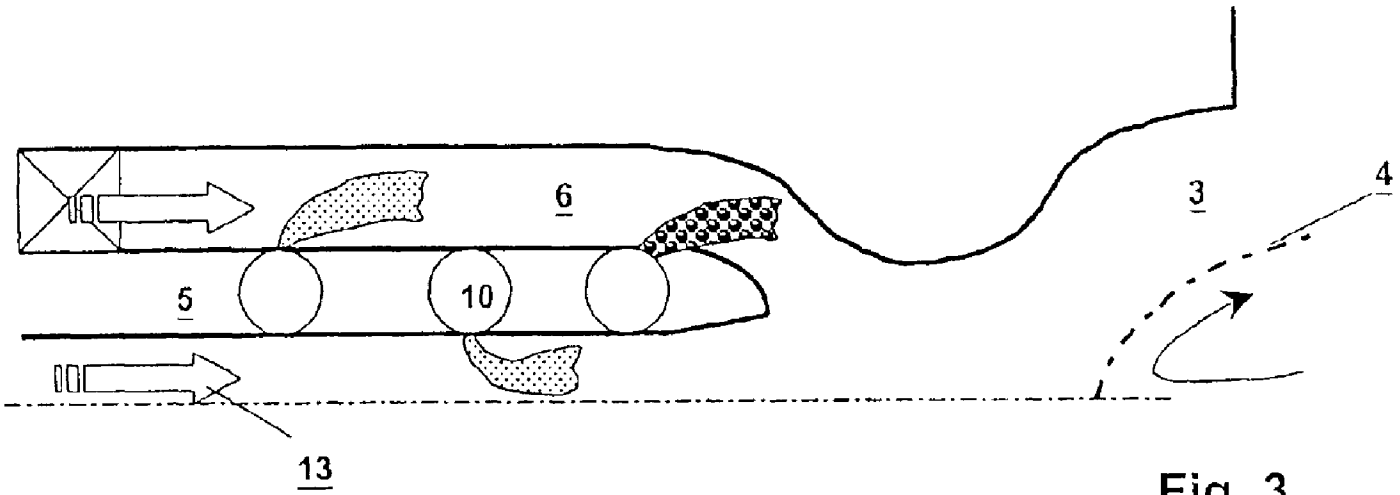

FIG. 3 shows a premix burner with a fuel-addition unit 10 for feeding gaseous fuel into the inner flow passage 7 which, unlike in the exemplary embodiment shown in FIG. 1, is at an axial distance from the downstream end of the burner lance 5. This type of pilot gas supply into the inner flow passage 7, which takes place at an axial distance from the flame front 4 which forms inside the combustion chamber 3 and is not ignited as a diffusion flame, is able to mix with the primary air 13 supplied and to mix with the remaining fuel/air mixture emanating from the annular flow passage 6. A premix pilot gas supply of this type is used in particular to increase the power of the premix burner for gas turbine operation under a high level of load.

Figure 4:
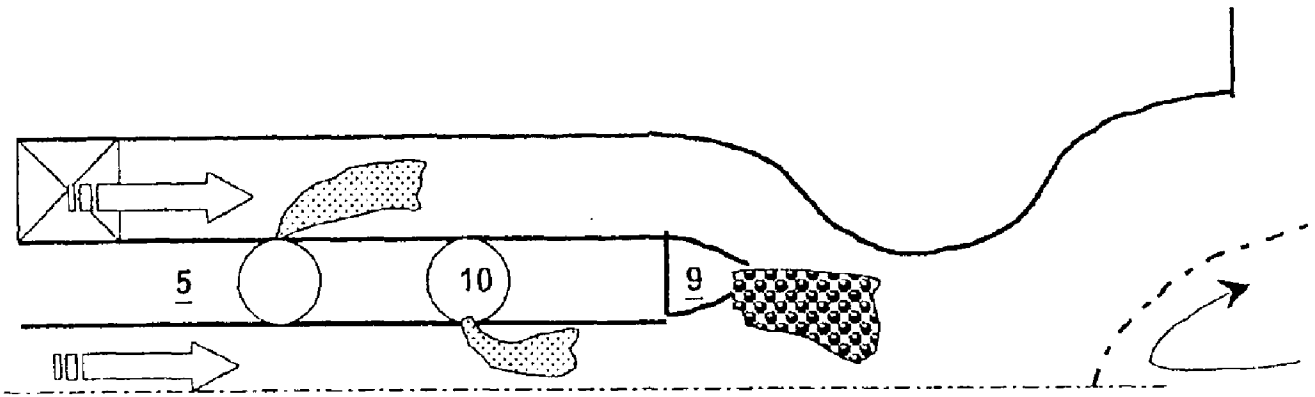
Figure 5:
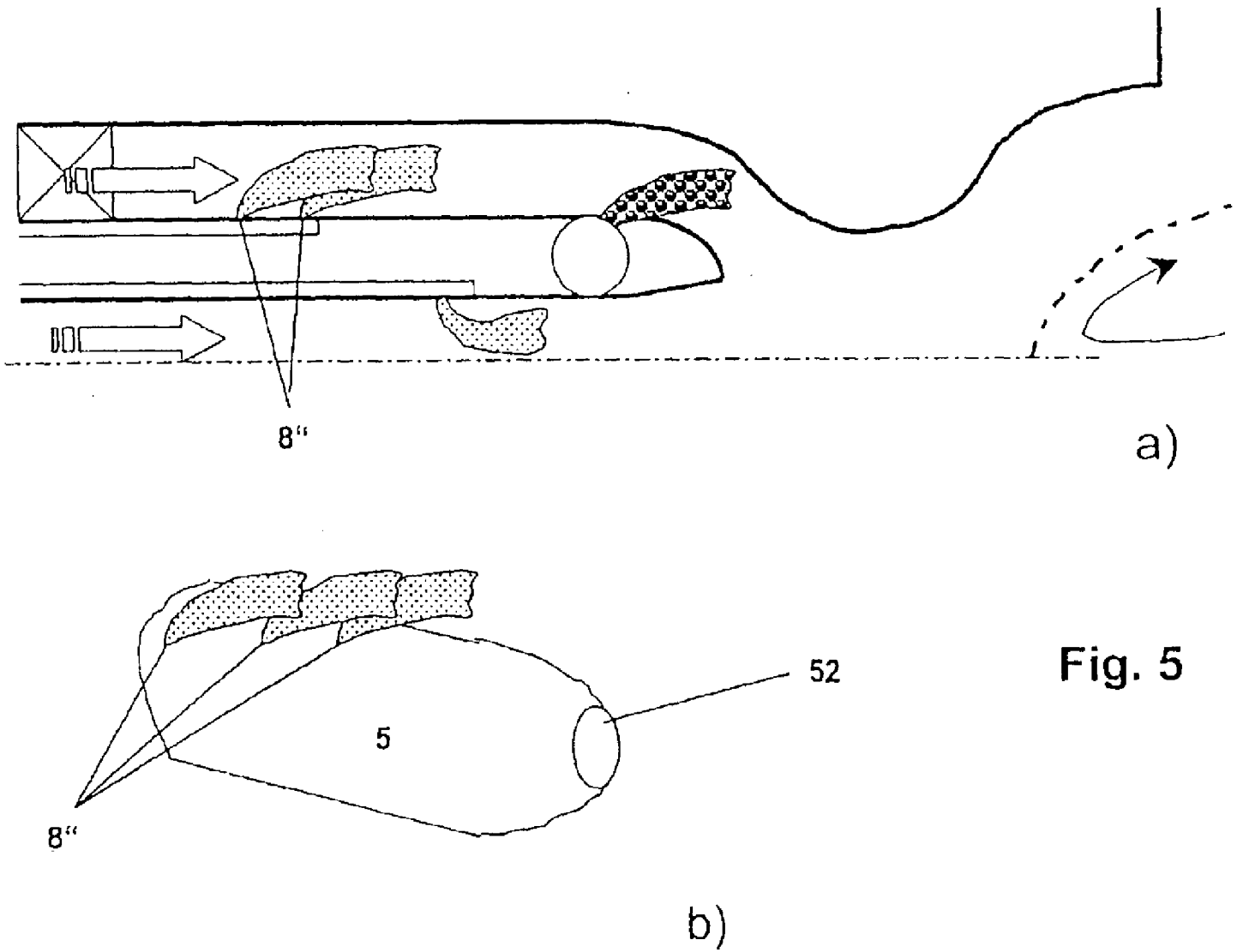

Unlike the exemplary embodiment shown in FIG. 3, FIG. 4 provides for liquid fuel to be injected right at the end of the burner lance 5. With the aid of a measure of this type, it is possible in particular to influence the three-dimensional axial position of the flame front 4 and, moreover, to influence the fuel/air ratio in the mixing region.

FIG. 5*a* shows a multistage fuel-addition unit 8" for feeding gaseous fuel into the annular flow passage 6. FIG. 5*b* shows a perspective illustration of the burner lance 5 which has an outlet opening 52 through which the inner flow passage 7 opens out. At the outer side of the inner tube wall 51 of the burner lance 5 there are a plurality of fuel-addition openings 8" which follow one another in the axial direction and through which gaseous fuel opens out into the annular flow passage 6. The fuel-addition openings 8" may either be arranged linearly in succession in the axial direction or else may be positioned circularly offset with respect to one another.

Figure 6:
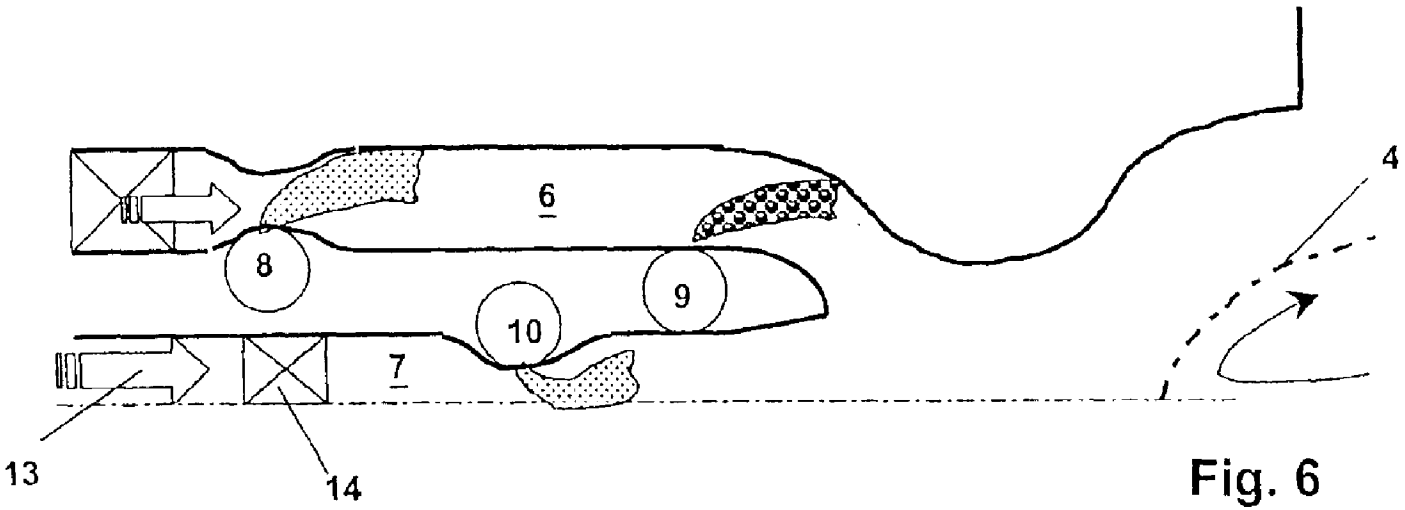

In FIG. 6, the annular flow passage and the inner flow passage have, at locations at which a gaseous fuel-addition unit 8, 10 is provided, a conically narrowed cross section of flow, the fuel-addition unit being fitted at the narrowest cross section of flow in order to avoid local flow return (flashback). In addition, there is a further swirl generator 14, which swirls up the primary air 13 with a defined swirl number, in the inner flow passage 7.

Figure 7:
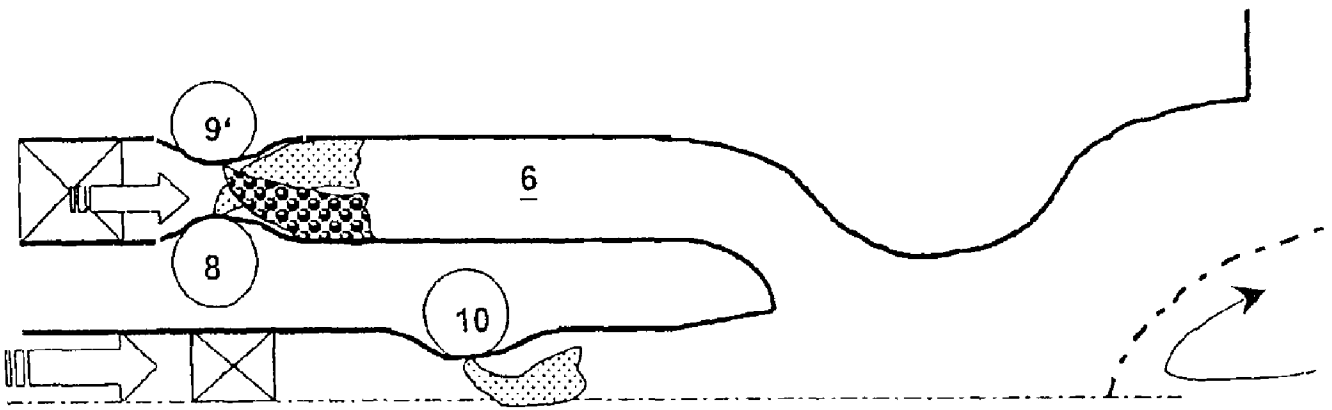

Unlike in the exemplary embodiment shown in FIG. 6, the exemplary embodiment shown in FIG. 7 provides a fuel-addition unit 9' through which liquid fuel is fed into the annular flow passage 6 from the side of the premix burner casing 1. In this case too, the premix burner casing wall and the inner tube wall 51 have, at the locations where the fuel is fed in, contours designed in the manner of a venturi nozzle.

Unlike in the exemplary embodiments described above, the burner lance 5 shown in FIG. 8 has, at the downstream region, a contour 15 which is designed as a diffuser and which conically widens the cross section of flow of the inner flow passage 7. In conjunction with a swirl generator 14 positioned upstream inside the inner flow passage 7 and a fuel-addition unit 10, which is integrated inside the burner lance 5 downstream of the swirl generator 14 and is used to feed gaseous fuel into the inner flow passage 7, the result is a swirling fuel/air flow which, on account of the widening cross section of flow, breaks open in the region of a first backflow zone 161, is ignited and forms a first stable flame front 16. The flue gases formed inside the first combustion stage are fed to the axially downstream combustion, beginning with the stable flame front 4, a further combustion operation, with the result that the $NO_x$ exhaust levels can be reduced considerably.

Figure 8:
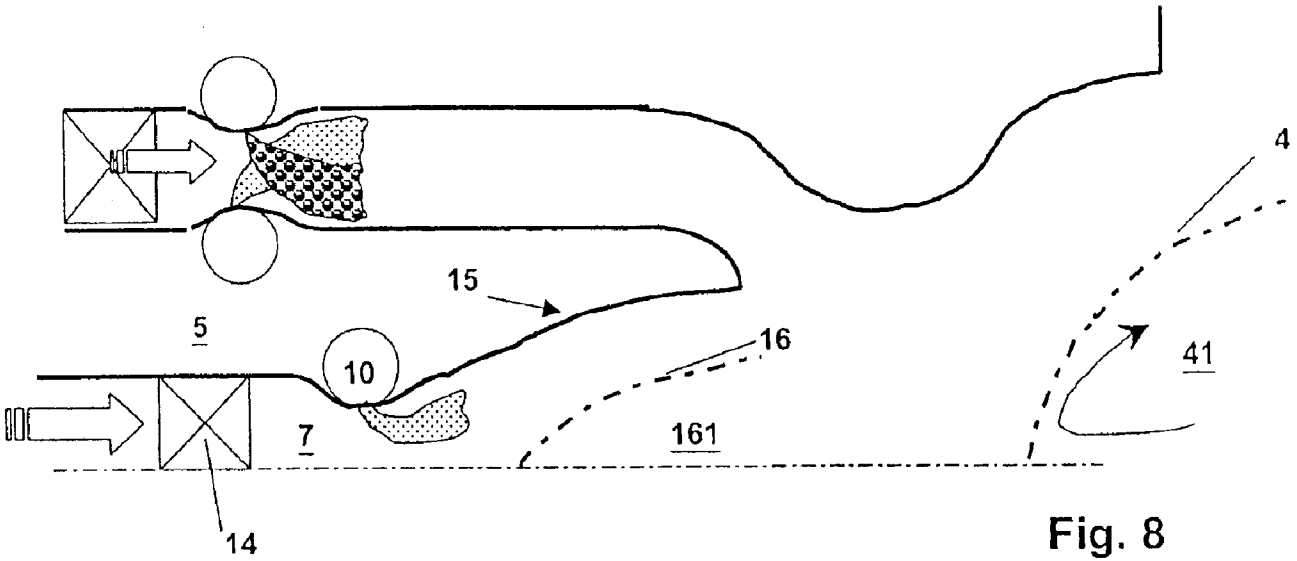
FIGS. 8 and 9 show different exemplary embodiments of a premix burner designed in accordance with the invention with two-stage combustion.
Figure 9:
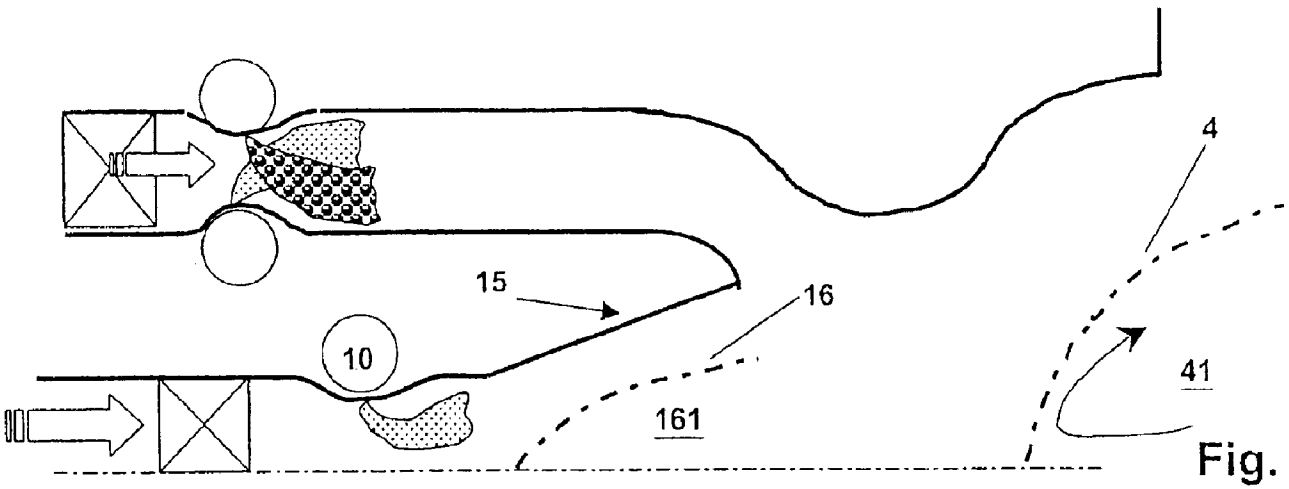

The exemplary embodiment shown in FIG. 9 shows a diffuser 15 which, unlike in FIG. 8, is designed to be rectilinear and which makes it possible to implement two-stage combustion in the same way.

Obviously, numerous modifications and variations of the present invention are possible in light of the above teachings. It is therefore to be understood that within the scope of the appended claims, the invention may be practiced otherwise than as specifically described herein.

LIST OF DESIGNATIONS

1 Premix burner casing
2 Transition contour
3 Combustion chamber
4 Flame front
41 Backflow zone
5 Burner lance
51 Inner tube wall
52 Outlet opening
6 Annular flow passage
7 Inner flow passage
8, 9, 10 Fuel-addition units
11 Swirl generator
12 Secondary air
13 Primary air
14 Swirl generator
15 Diffuser
16 Flame front
161 Backflow zone

What is claimed is:

1. A premix burner, suitable for forming at least one stable flame front in a combustion chamber, for use with means for supplying fuel and air to said premix burner, and with means for mixing fuel and air to form a fuel/air mixture for subsequent combustion in the combustion chamber, said burner comprising:

a premix burner casing, having an upstream end and a downstream end defining a flow direction, said burner casing comprising a tube which is open at an upstream end, has a transition contour, and is in fluid communication with the combustion chamber at a tube downstream end via the transition contour, for flowing air therethrough;

a burner lance comprising an inner tube having an outer wall and projecting into the interior of the premix burner casing on the premix burner casing upstream end to form an annular flow duct with the burner casing, the burner lance having:

an upstream end, a downstream end, and an inner tube wall forming an inner flow passage enclosed by said inner tube wall;

at least one first fuel supply unit on the inner tube wall to supply fuel into the inner flow passage; and at least one second fuel supply unit on the outer wall of the burner lance to supply fuel into the annular flow duct.

2. The premix burner as claimed in claim 1, wherein the inner tube is open at the upstream and downstream ends.

3. The premix burner as claimed in claim 1, wherein the transition contour has an axial length, and the downstream end of the inner tube is located within the axial length of the transition contour.

4. The premix burner as claimed in claim 1, wherein the transition contour is convergent-divergent in the flow direction, comprising, in a first section, narrowing the clear cross section of the premix burner casing and then widening the clear cross section towards the downstream end.

5. The premix burner as claimed in claim 1, wherein the burner lance is configured and arranged to be fitted into the premix burner casing in a modular manner.

6. The premix burner as claimed in claim 1, further comprising:

a swirler on the outer wall of the inner tube for introducing a swirl motion into a flow through the annular duct.

7. The premix burner as claimed in claim 1, further comprising:

a swirler on the inner wall of the inner tube for introducing a swirl motion into a flow through the inner flow passage.

8. The premix burner as claimed in claim 1, wherein the fuel supply units are configured and arranged for feeding either gaseous fuel or liquid fuel into both the inner flow passage and the annular flow duct.

9. The premix burner as claimed in claim 1, wherein at least one second fuel supply unit is adapted to supply gaseous fuel to the annular flow passage, and further comprising at least one further fuel supply unit adapted to supply liquid fuel to the annular flow passage and positioned on the inner tube downstream of the second fuel supply unit.

10. The premix burner as claimed in claim 1, wherein at least one fuel supply unit is provided on the downstream side of the inner tube, said fuel supply unit being arranged and adapted to supply liquid fuel into a mixing zone which is defined by the transition contour.

11. The premix burner as claimed in claim 1, wherein at least two fuel supply units are arranged axially offset to one another, and are configured and arranged to supply fuel to one space selected from the group consisting of the annular flow duct and the inner flow passage.

12. The premix burner as claimed in claim 1, wherein the inner tube wall is formed such that the inner flow passage has an essentially constant flow cross section along the axial extent of the burner lance.

13. The premix burner as claimed in claim 12, further comprising:

a fuel supply unit for feeding gaseous fuel into the inner flow passage and operable as a pilot gas supply arranged on the downstream end of the burner lance.

14. The premix burner as claimed in claim 12, further comprising:

a fuel supply unit for feeding gaseous fuel into the inner flow passage and operable as a premix gas supply arranged upstream of the downstream end of the burner lance.

15. The premix burner as claimed in claim 1, wherein the inner wall of the inner tube is contoured such that the inner flow passage has an essentially constant flow cross section, with a divergent downstream end section, and further comprising a swirl generator in the inner flow passage upstream of the divergent section.

16. The premix burner as claimed in claim 15, further comprising:

at least one fuel supply means for feeding gaseous fuel into the inner flow passage and positioned immediately upstream of the divergent section on the inner tube wall, the at least one fuel-addition unit capable of causing a first flame front to stabilize within the divergent section of the inner flow channel, and a second flame front to stabilize downstream of the inner tube.

17. The premix burner as claimed in claim 1, wherein an element selected from the group consisting of the casing inner contour, the inner tube outer contour, the inner tube inner contour, and combinations thereof, being configured and arranged to provide a divergent-convergent venturi flow cross section of the inner flow passage, the annular flow duct, or both, at the location of a fuel supply unit.

18. A method for firing a combustion chamber for driving a gas turbine using the modular premix burner as claimed in claim 1, comprising the steps of:

generating a premixed air/fuel mixture vortex flow in the annular passage, said vortex flow forming a stable premixed flame front within the combustion chamber after having passed the transition contour;

supplying gaseous fuel into the inner flow passage essentially at the downstream end of the burner lance;

using said gaseous fuel as pilot gas; and burning said pilot gas in a diffusion flame.

19. A method for firing a combustion chamber for driving a gas turbine using the modular premix burner as claimed in claim 1, comprising the steps of:

generating a premixed air/fuel mixture vortex flow in the annular passage, said vortex flow forming a stable premixed flame front within the combustion chamber after having passed the transition contour;

providing a divergent end section of the inner flow channel at the downstream end of the burner lance;

supplying gaseous fuel into the inner flow passage essentially at the downstream end of the burner lance such that an additional flame front is formed axially upstream of the premixed flume front.

20. The premix burner as claimed in claim 2, further comprising means for flowing air through the inner tube.

21. A method for firing a combustion chamber for driving a gas turbine using the modular premix burner as claimed in claim 1, comprising the steps of:

generating a premixed air/fuel mixture vortex flow in the annular passage, said vortex flow forming a stable premixed flame front within the combustion chamber after having passed the transition contour;

supplying gaseous fuel into the inner flow passage essentially upstream of the downstream end of the burner lance;

using said gaseous fuel as premix gas; and mixing said premix gas with air flowing through the inner flow passage.

22. A method of using the premix burner as claimed in claim 1 as a modular premix burner comprising:

providing the premix burner casing as a standard module;

providing a plurality of different burner lances, said plurality of different burner lances comprising different fuel supply units, swirl generators, or both; and modularly integrating at least one burner lance into the premix burner casing.

23. The premix burner as claimed in claim 1, further comprising:

means for supplying fuel and air to said premix burner; and means for mixing fuel and air to form a fuel/air mixture for subsequent combustion in the combustion chamber.

* * * * *